US009268292B2

(12) United States Patent
Kojima et al.

(10) Patent No.: US 9,268,292 B2
(45) Date of Patent: Feb. 23, 2016

(54) IMAGE FORMING APPARATUS INCLUDING FIRST AND SECOND BIAS VOLTAGE SUPPLY DEVICES

(71) Applicants: Takeshi Kojima, Yokohama (JP); Hirotaka Hatta, Kawasaki (JP); Toshiya Satoh, Atsugi (JP); Akira Asaoka, Ebina (JP); Hiroyuki Uenishi, Chigasaki (JP); Yusuke Ishizuka, Yokahama (JP)

(72) Inventors: Takeshi Kojima, Yokohama (JP); Hirotaka Hatta, Kawasaki (JP); Toshiya Satoh, Atsugi (JP); Akira Asaoka, Ebina (JP); Hiroyuki Uenishi, Chigasaki (JP); Yusuke Ishizuka, Yokahama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/026,263

(22) Filed: Sep. 13, 2013

(65) Prior Publication Data

US 2014/0126942 A1 May 8, 2014

(30) Foreign Application Priority Data

Nov. 8, 2012 (JP) ..... 2012-246089
May 24, 2013 (JP) ..... 2013-110185

(51) Int. Cl.
*G03G 21/00* (2006.01)

(52) U.S. Cl.
CPC ..... *G03G 21/0035* (2013.01); *G03G 21/0023* (2013.01)

(58) Field of Classification Search
CPC ..... G03G 21/0035; G03G 21/0023
USPC ..... 399/353, 354
See application file for complete search history.

(56) References Cited

U.S. PATENT DOCUMENTS

| | | | | |
|---|---|---|---|---|
| 2007/0209877 | A1 | 9/2007 | Arai et al. | |
| 2007/0286643 | A1 * | 12/2007 | Kinokuni | 399/128 |
| 2010/0247123 | A1 | 9/2010 | Honjoh et al. | |
| 2010/0260511 | A1 * | 10/2010 | Kojima et al. | 399/46 |
| 2011/0026992 | A1 * | 2/2011 | Shintani et al. | 399/346 |
| 2011/0064433 | A1 | 3/2011 | Asaoka et al. | |
| 2011/0158666 | A1 * | 6/2011 | Furukawa | 399/46 |
| 2012/0087704 | A1 | 4/2012 | Asaoka et al. | |
| 2012/0099883 | A1 | 4/2012 | Kikuchi et al. | |
| 2012/0195616 | A1 * | 8/2012 | Miyahara | 399/55 |
| 2013/0209117 | A1 * | 8/2013 | Ikeda | 399/50 |

FOREIGN PATENT DOCUMENTS

| | | |
|---|---|---|
| JP | 2007-121716 | 5/2007 |
| JP | 2007-121718 | 5/2007 |
| JP | 2007-121719 | 5/2007 |
| JP | 2008304812 A * | 12/2008 |
| JP | 4597837 | 10/2010 |

* cited by examiner

*Primary Examiner* — Billy Lactaoen
(74) *Attorney, Agent, or Firm* — Oblon, McClelland, Maier & Neustadt, L.L.P.

(57) ABSTRACT

An image forming apparatus includes a first image forming device, a plurality of second image forming devices, a first bias voltage supply device, and a second bias voltage supply device. The first image forming device and the second image forming device form a toner image. The first bias voltage supply device applies a bias voltage to a first component of the first image forming device. The second bias voltage supply device applies a bias voltage to a second component of each of the plurality of second image forming devices.

19 Claims, 11 Drawing Sheets

IMAGE FORMING APPARATUS INCLUDING FIRST AND SECOND BIAS VOLTAGE SUPPLY DEVICES

CROSS-REFERENCE TO RELATED APPLICATIONS

This application is based on and claims priority from Japanese Patent Application Nos. 2012-246089, filed on Nov. 8, 2012, and 2013-110185, filed on May 24, 2013, in the Japan Patent Office, the contents of which are incorporated herein by reference in their entirety.

BACKGROUND

1. Field

This disclosure generally relates to an image forming apparatus such as a printer, a facsimile machine, or a copier.

2. Discussion of the Background

A tandem-type image forming apparatus forms a color image to lay a toner image of each color (black, yellow, magenta, and cyan) on the surface of a transfer member. An image-forming unit includes a photoconductive drum, a charge device, a developing device, and a cleaning device. The charge device forms a latent image on a surface of the photoconductive drum charged, which has been uniformly charged. The developing device forms a toner image to develop the latent image. The cleaning device removes untransferred toner on the surface of the photoconductive drum after transferring the toner image to a transfer member.

Japanese Patent No. 4597837 discloses a cleaning device that includes a cleaning brush roller to be rotatable and to contact with a surface of a photoconductive drum and a voltage application member to apply a voltage to a cleaning brush roller for adhering toner electrically. The cleaning brush electrically and mechanically removes the untransferred toner on a surface of the photoconductive drum after transferring the toner image to a transfer member.

A conventional image forming apparatus that includes a power supply unit for each cleaning brush roller of each color (black, yellow, magenta, and cyan) has a high cost and an increased size. Thus, it is necessary to reduce the number of power supply units so that individual power supply units do not apply a bias voltage to each cleaning brush roller.

Further, it is not always necessary to use each colored image-forming unit when using an image forming apparatus included a plurality of image-forming units. Namely, an image forming apparatus can operate in a monochrome mode in which a black toner image is formed using only an image-forming unit for black, and in a color mode in which a color toner image is formed using every image-forming unit.

Therefore, conventionally the power supply unit applies a bias voltage to the cleaning brush rollers of the image-forming units for black as well as yellow, magenta, and cyan, when the image forming apparatus prints a sheet in monochrome mode.

Conventionally, the power supply unit applies power not just to the cleaning brush roller, but also, e.g., to a charge device of the image-forming unit.

SUMMARY

In one embodiment, an image forming apparatus includes a first image forming device to form a toner image, a plurality of second image forming devices to form corresponding toner images, a first bias voltage supply device to apply a first bias voltage to a first component of the first image forming device, and a second bias voltage supply device to apply a second bias voltage to a second component of each of the plurality of the second image forming devices.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
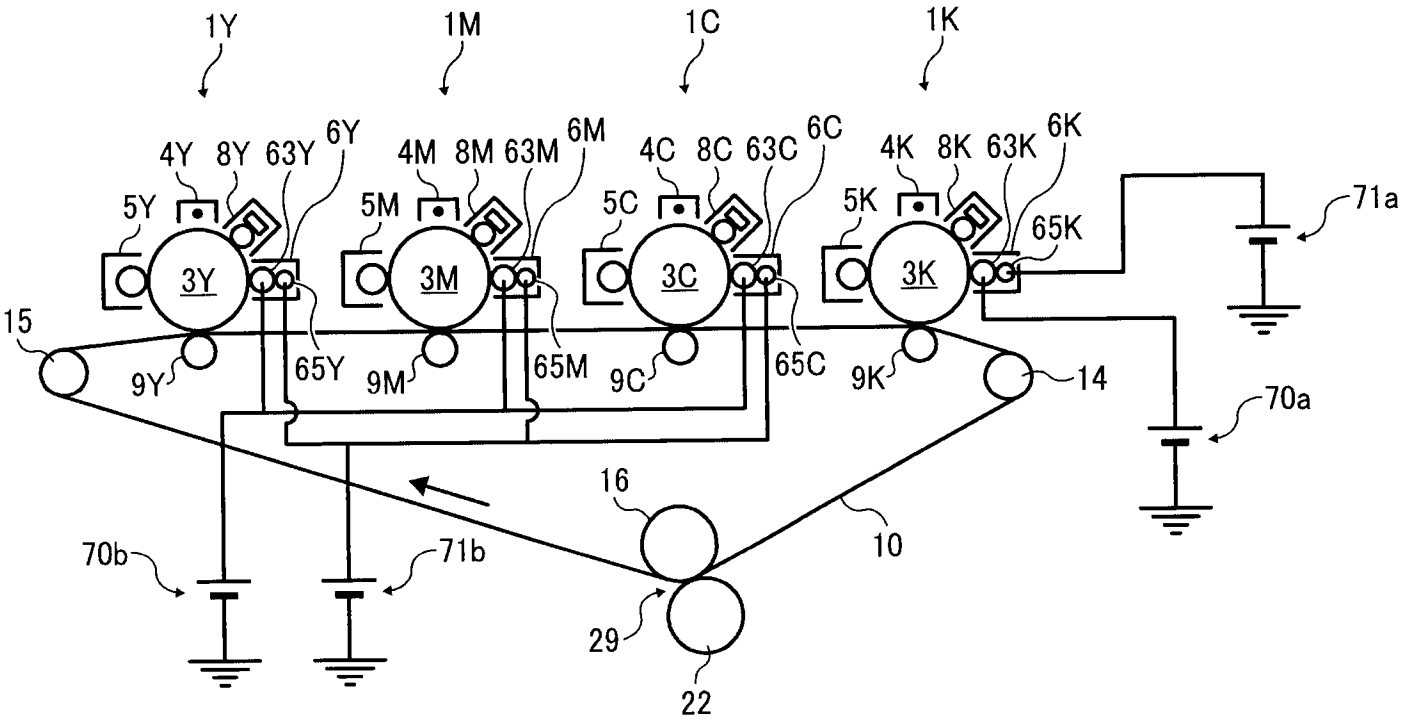
FIG. 1 is a schematic view of each photoconductive drum and an intermediate transfer belt according to a full-color mode.

In describing the implementations illustrated in the drawings, specific terminology is employed for the sake of clarity. However, this disclosure is not intended to be limited to the specific terminology so selected, and it is to be understood that each specific element includes all technical equivalents that operate in a similar manner and achieve a similar result.

The same members in each configuration are attached with the same reference numbers. In addition, explanations for the same effects in different configuration examples may be omitted.

Figure 2:
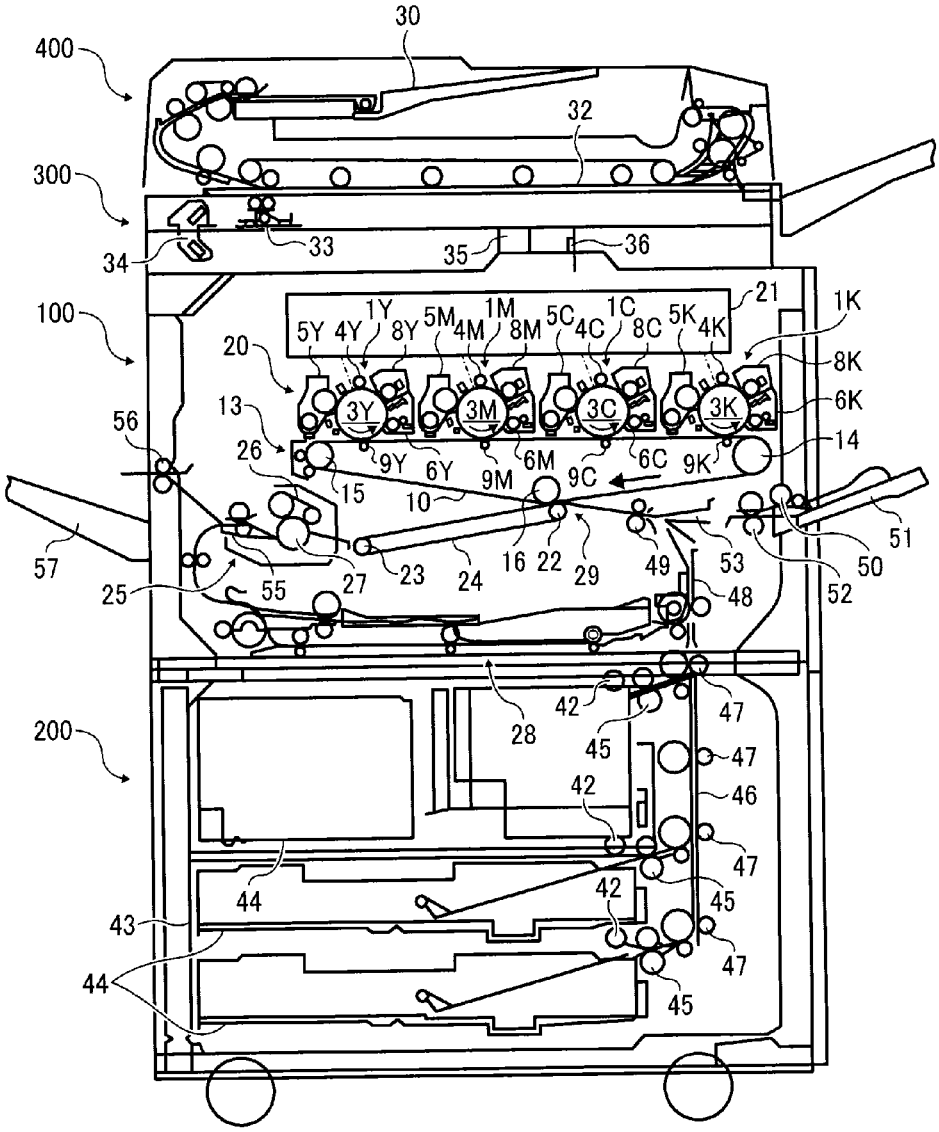
FIG. 2 is a schematic view of an image forming apparatus according to an illustrative embodiment.

A structure of a tandem type color image forming apparatus is shown in FIG. 2 as an example of an image forming apparatus according to an exemplary implementation of this disclosure.

FIG. 2 shows a schematic view of an image forming apparatus, according to an embodiment of the present advancements. The image forming apparatus includes a printer part 100 as a main body, a feeding part 200, a scanner 300 arranged above the printer part 100, and an auto document feeder (ADF) 400 located on the scanner 300. Moreover, the image forming apparatus includes a controller 90 (shown in FIG. 15) that controls the operations of each device of the image forming apparatus.

The printer part 100 includes an intermediate transfer belt 10 serving as an intermediate transfer member located at a center of the printer part 100. The intermediate transfer belt 10 is looped over a first support roller 14, a second support roller 15, and a third support roller 16, and is driven clockwise. Four photoconductive drums 3Y, 3M, 3C, and 3K, which correspond to each of yellow, magenta, cyan, and black color toner images, are arranged along a surface of the intermediate transfer belt 10. Each photoconductive drum carries a corresponding toner image of each color.

Charge devices 4Y, 4M, 4C, and 4K, which respectively charge equally a surface of the each of the photoconductive drums 3Y, 3M, 3C, and 3K, and developing devices 5Y, 5M, 5C, and 5K, which respectively develop a toner image on the surface of each of the photoconductive drums 3Y, 3M, 3C, and 3K, are arranged around each of the photoconductive drums 3Y, 3M, 3C, and 3K. Moreover, cleaning devices 6Y, 6M, 6C, and 6K, which respectively remove untransferred toner on each of the photoconductive drums 3Y, 3M, 3C, and 3K, and lubricant applying devices 8Y, 8M, 8C, and 8K, which respectively apply a lubricant on the surface of each of the photoconductive drums 3Y, 3M, 3C, and 3K, are arranged around each of the photoconductive drums 3Y, 3M, 3C, and 3K.

Image forming devices 1Y, 1M, 1C, and 1K respectively include photoconductive drums 3Y, 3M, 3C, and 3K, the developing devices 5Y, 5M, 5C, and 5K, the charge devices 4Y, 4M, 4C, and 4K, and the cleaning devices 6Y, 6M, 6C, and 6K. The four image forming devices 1Y, 1M, 1C, and 1K are arranged horizontally in a tandem image forming unit 20.

The image forming devices 1K, 1Y, 1M, and 1C also may be arranged along a rotating direction of the intermediate transfer belt 10.

The intermediate transfer belt 10 is sandwiched between the belt cleaning device 13 and the third support roller 15. The belt cleaning device 13 removes untransferred toner that remains on the surface of the intermediate transfer belt 10. The printer part 100 includes an exposure device 21 arranged above the tandem image forming unit 20.

Primary transfer rollers 9Y, 9M, 9C, and 9K are arranged inside of the intermediate transfer belt 10, and the primary transfer rollers and the photoconductive drums 3Y, 3M, 3C, and 3K sandwich the intermediate transfer belt 10. The primary transfer rollers 9Y, 9M, 9C, and 9K are primary transfer parts, and press the intermediate transfer belt 10 to the photoconductive drums 3Y, 3M, 3C, and 3K.

A secondary transfer device 29 includes a secondary transfer roller 22, a secondary transfer belt extending roller 23, and a secondary transfer belt 24. The secondary transfer roller 22 and the secondary transfer belt extending roller 23 extend the secondary transfer belt 24. A secondary transfer device 29 and the third support roller 16 sandwich the intermediate transfer belt 10 and the secondary transfer belt 24. The secondary transfer belt 24 and the intermediate transfer belt 10 form a secondary transfer nip.

The fixing device 25 is arranged downstream in a sheet conveyance direction relative to the secondary transfer device 29, and fixes the toner on the sheet. The fixing device 25 includes a pressure roller 27 and the fixing belt 26, which is an endless belt. The secondary transfer belt 24 conveys the transferred sheet to the fixing device 25. The secondary transfer device 29 may include a secondary transfer roller instead of the secondary transfer belt 24.

A sheet reversing device is arranged under The secondary transfer device 29 and the fixing device 25, and is arranged parallel with the tandem image forming unit 20. The sheet-reversing device 28 reverses a sheet for transferring an image to a second surface of the sheet. A switching member 55 switches a sheet-conveyance direction with the sheet-reversing device 28 and a discharge roller 56. A stack tray 57 stacks the sheet that passes the fixing device 25.

Figure 15:
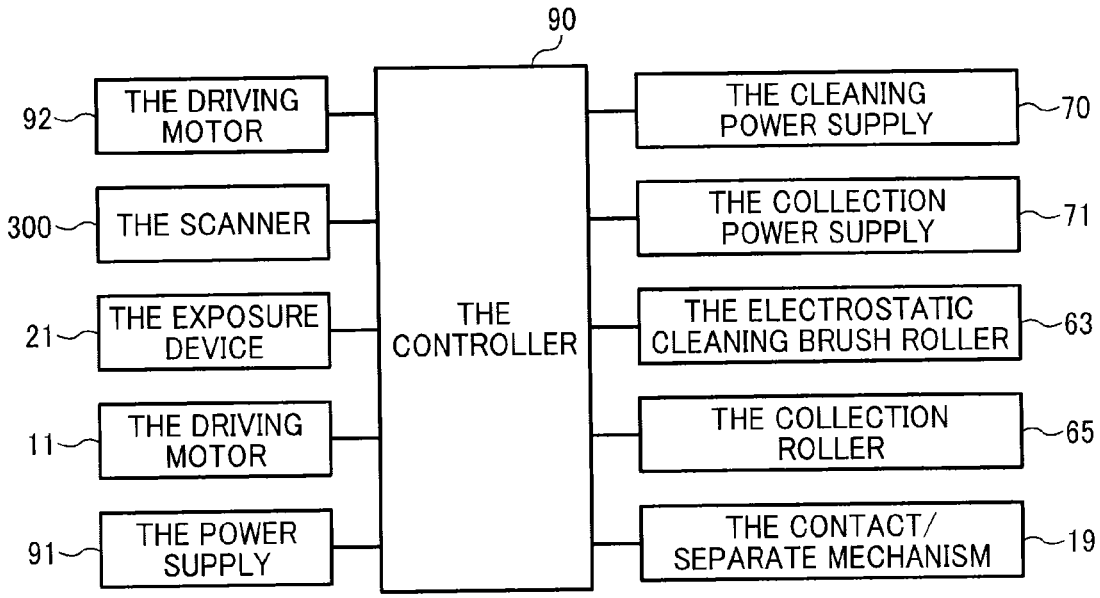
FIG. 15 is a block diagram of an image forming apparatus.

The scanner 300 includes an image reading sensor 36 to read image information from documents positioned on an exposure glass 32, and sends the read image information to the controller 90 shown in FIG. 15

Based on the image information received from the scanner 300, the controller 90 controls a laser, an LED, or the like positioned in an exposure device 21 that irradiates a writing laser beam "L" (shown in FIG. 6) onto the photoconductive drums 3Y, 3M, 3C, and 3K. Through this irradiation, latent electrostatic images are formed on the surfaces of the photoconductive drums 3Y, 3M, 3C, and 3K, and the latent electrostatic images are developed into toner images through an image developing process.

The feeding part 200 includes a sheet bank 43. The sheet bank 43 includes sheet feeding cassettes 44, sheet feeding rollers 42 that extract sheets from the sheet feeding cassettes 44, sheet separating rollers 45 that separate the sheets and feed a sheet sequentially to a sheet feeding path 46, and sheet conveying rollers 47 that feed the sheet to a sheet feeding path 48.

In addition to the feeding part 200, the printer part 100 includes a manual sheet feeder. The manual sheet feeder includes a sheet-feeding tray 51 and a sheet separating roller 52 that separates each sheet.

A resist roller 49 discharges a sheet from any one of the sheet feeding cassettes 44 or the sheet feeding tray 51, and sends the sheet to the secondary transfer nip.

When making copies of a color document, an operator sets the color document on a document stand 30 of the auto document feeder 400, or sets the color document on the exposure glass 32.

Then the operator pushes a START key, the auto document feeder 400 conveys the document onto the exposure glass 32, and the scanner 300 is activated. Alternatively, when the operator sets a document on the exposure glass 32 and pushes the START key, the scanner 300 is activated immediately to move a primary scanning member 33 and a secondary scanning member 34.

Light is emitted from a light source at the primary scanning member 33, and then the light reflects off the surface of the document, and is further reflected towards the secondary scanning member 34. A mirror of the secondary scanning member 34 reflects the light through an imaging lens 35 onto an image reading sensor 36 that reads the image information.

The charge devices 4Y, 4M, 4C, and 4K uniformly charge a surface of the photoconductive drums 3Y, 3M, 3C, and 3K, respectively. The exposure device 21 irradiates the photoconductive drums 3Y, 3M, 3C, and 3K with image data read by the scanner 300 to form latent electrostatic images on the photosensitive members 3K, 3Y, 3M and 3C, respectively.

The latent electrostatic images on the photoconductive drums 3Y, 3M, 3C, and 3K are developed by the developing devices 5Y, 5M, 5C, and 5K, respectively, to form respective toner images on the surface of the photoconductive drums 3Y, 3M, 3C, and 3K. A driving motor drives one of the sheet feeding rollers 42 for feeding the sheet corresponding to the image information.

At the same time, a driving motor 11 (shown in FIG. 15) drives one of the first support roller 14, the second support roller 15, and the third support roller 16 to rotate the intermediate transfer belt 10. The images respectively formed on the surface of the photoconductive drums 3Y, 3M, 3C, and 3K are sequentially transferred to the intermediate transfer belt 10 in accordance with the rotation of the intermediate transfer belt 10, completing a full-color image on the surface of the intermediate transfer belt 10.

One of the sheet-feeding rollers 42 of the sheet feeding part 200 is selectively rotated, and sheets from one of the sheet feeding cassettes 44 are extracted and fed one-by-one, by the sheet separating roller 45, to the sheet feeding path 46. The sheet is guided on the sheet feeding path 46 by sheet conveying rollers 47, and stopped by the resist roller 49.

Alternatively, a sheet feeding roller 50 rotates to extract a sheet from the manual sheet feeding tray 51. The sheet separating roller 52 separates sheets one-by-one into a sheet feeding path 53. The resist roller 49 stops the sheet.

The resist roller 49 rotates to align with the composite color image on the intermediate transfer belt 10 and convey the sheet to the secondary transfer nip. The composite color image is transferred onto the sheet under the influence of an electrical field for image transfer and contact pressure in the secondary transfer nip.

The secondary transfer belt 24 conveys the sheet with the transferred color toner image to the fixing device 25. The fixing device 25 fixes the color toner image on the sheet with heat and pressure by the pressure roller 27 and the fixing belt. In a simplex print mode, the discharge roller 56 discharges the sheet, and the sheet is stacked on the stack tray 57.

In a duplex print mode, the switching member 55 guides the sheet to the sheet-reversing device 28. The sheet-reversing device 28 reverses the sheet and conveys the sheet to the resist roller 49. The secondary transfer device 29 transfers the color toner image onto a second surface of the sheet. The discharge roller 56 discharges the sheet, and the sheet is stacked on the stack tray 57.

After the secondary image transfer, the belt cleaning device 13 removes the untransferred toner remaining on a surface of the intermediate transfer belt 10. The tandem image forming unit 20 prepares the next image formation.

A lifetime of a photoconductive drum and a cleaning device of an image forming apparatus need to be long. In particular, when using an image-forming device according to one embodiment, the lifetime of the photoconductive drum is improved. Further, the running cost of the cleaning device is reduced when a printer, when used for production printing, prints a large number of sheets.

Figure 3:
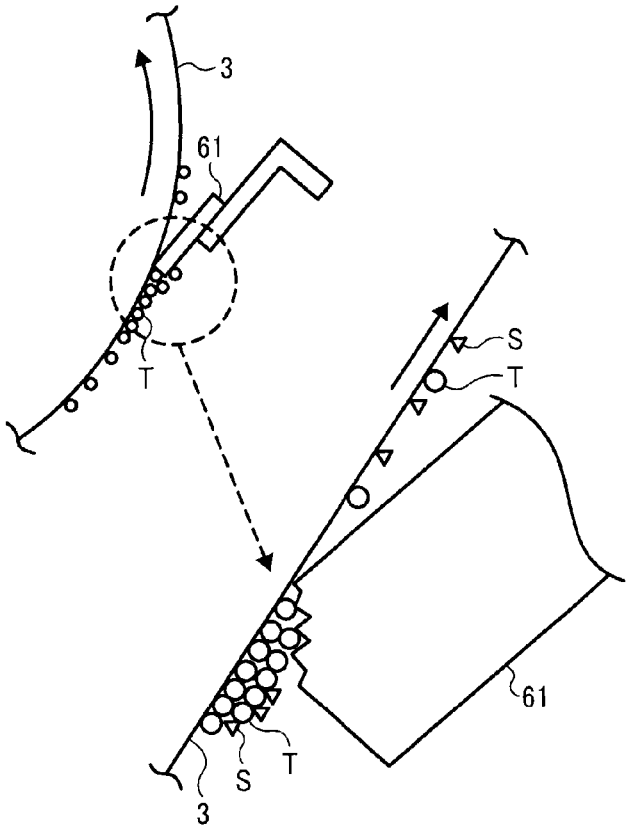
FIG. 3 illustrates a cleaning device using a cleaning blade.

It is necessary to reduce an abrasion speed of an edge of a cleaning blade for improving a lifetime of the cleaning device. The cleaning device using a cleaning blade 61 has a simple construction and almost completely removes toner "T" by contacting a photoconductive drum in a counter direction with respect to a rotation direction of the photoconductive drum 3, as shown in FIG. 3.

The lifetime of the cleaning device using the cleaning blade 61 depends on an amount of the abrasion of the edge of the cleaning blade 61. When the amount of abrasion increases, the toner "T" on the surface of the photoconductive drum 3 passes the cleaning blade 61, which causes a longitudinal seam image.

When the printer prints a large number of sheets including an image with a high image-area ratio, a large number of the toner particles "T" reach the edge of the cleaning blade 61. The abrasion of the edge advances when the toner "T" and a lubricant pass the edge of the cleaning blade 61.

An example of reducing the advance of abrasion of the edge is to ensure that the material of the blade is suitable. However, it is difficult to improve the lifetime of the blade 61 because properties of a polyurethane rubber can not be dramatically changed. An effective way of dramatically reducing the advance of the abrasion of the edge is to prevent a large amount of toner "T" from reaching the edge.

Next, silica "S", which is an additive agent of the toner, sticks to the surface of the photoconductive drum 3 when the silica passes the edge. When the silica is deposited, the silica bonds to the surface of the photoconductive drum 3. A region where the silica bonds appears as a white dot in the image because the toner is not able to adhere to the region.

Figure 4:
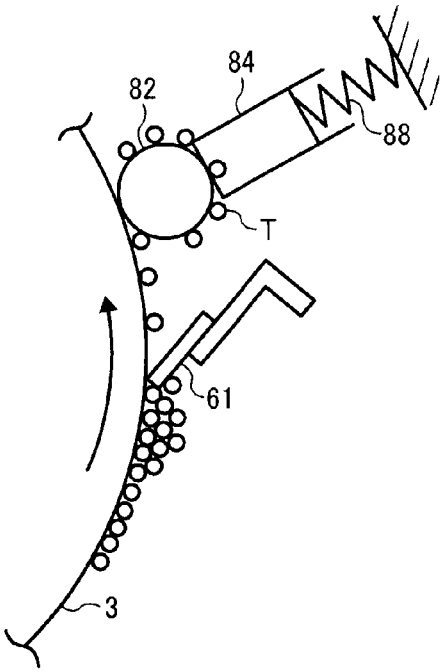
FIG. 4 illustrates a state in which a lubricant applying device applies a lubricant on the photoconductive drum.

In contrast, the construction shown in FIG. 4 is able to reduce a volume of the toner "T" reaching the edge. For example, the photoconductive drum 3 is protected from silica "S" by a lubricant layer that is formed by a lubricant applying device applying a lubricant of a lubricant body 84 to the photoconductive drum 3. However, when the printer prints a large number of sheets, including an image with a high image-area ratio, the lubricant applying device needs to apply a larger amount of lubricant. Thus, the lifetime of the lubricant body 84 decreases. Moreover, when the toner "T" that passes the edge adheres to an applying blush 82, the lifetime of lubricant body 84 also decreases.

Finally, a lifetime of the photoconductive drum 3 shortens from the toner "T" and silica "S" that scrape the surface of the photoconductive drum 3 when passing the edge.

In contrast, the thick surface of the photoconductive drum 3 causes residual electric charge to remain on the photoconductive drum. When a surface potential of the photoconductive drum 3 is not in a predetermined range, an image density changes.

Thus, reducing a thickness between the surface of the photoconductive drum 3 and a charge generation layer prevents a large amount of the toner "T" from reaching the edge.

Figure 5:
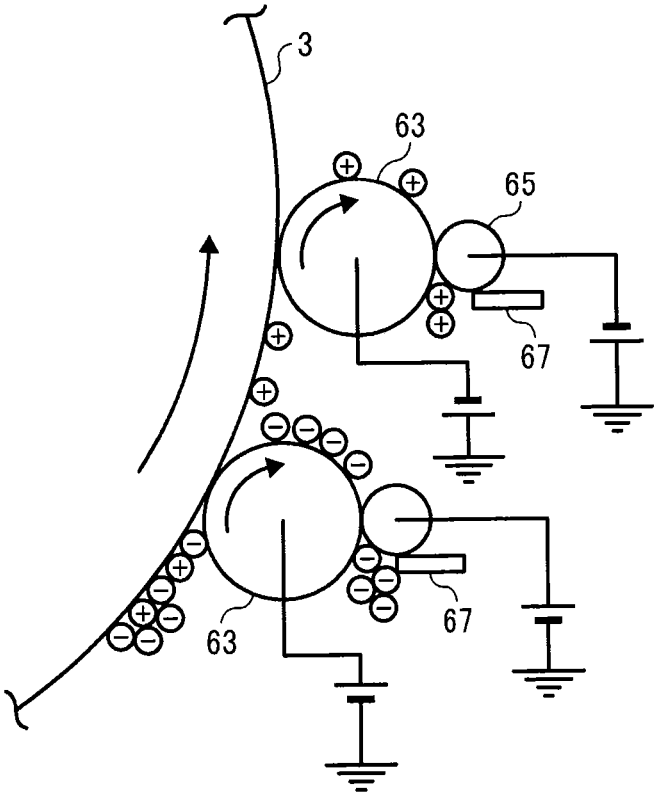
FIG. 5 illustrates an electrostatic cleaning device using an electrostatic cleaning brush roller.

Alternatively, FIG. 5 shows an electrostatic cleaning device as another cleaning device in which a voltage is applied to an electrostatic cleaning brush roller 63 and removes toner electrically.

A toner-removing ability of the electrostatic cleaning device is higher than that of the cleaning blade. The surface of the photoconductive drum does not adhere silica easily because the electrostatic cleaning device does not stress toner mechanically.

However, the electrostatic cleaning brush roller is unable to remove a little toner whose polarity is different from the polarity of the electrostatic cleaning brush roller. Thus, as shown in FIG. 5, for removing positive polarity toner and negative polarity toner, a cleaning device needs a plurality of electrostatic cleaning brush rollers and a plurality of toner polarity controllers that adjust toner polarity. However, the cost of such an image forming apparatus is higher.

In one embodiment, an image forming apparatus includes an electrostatic cleaning brush roller and a cleaning blade that are arranged downstream with respect to rotation of a photoconductive drum, and thus eliminate disadvantages of the cleaning blade and the electrostatic cleaning brush roller, as mentioned above.

Figure 6:
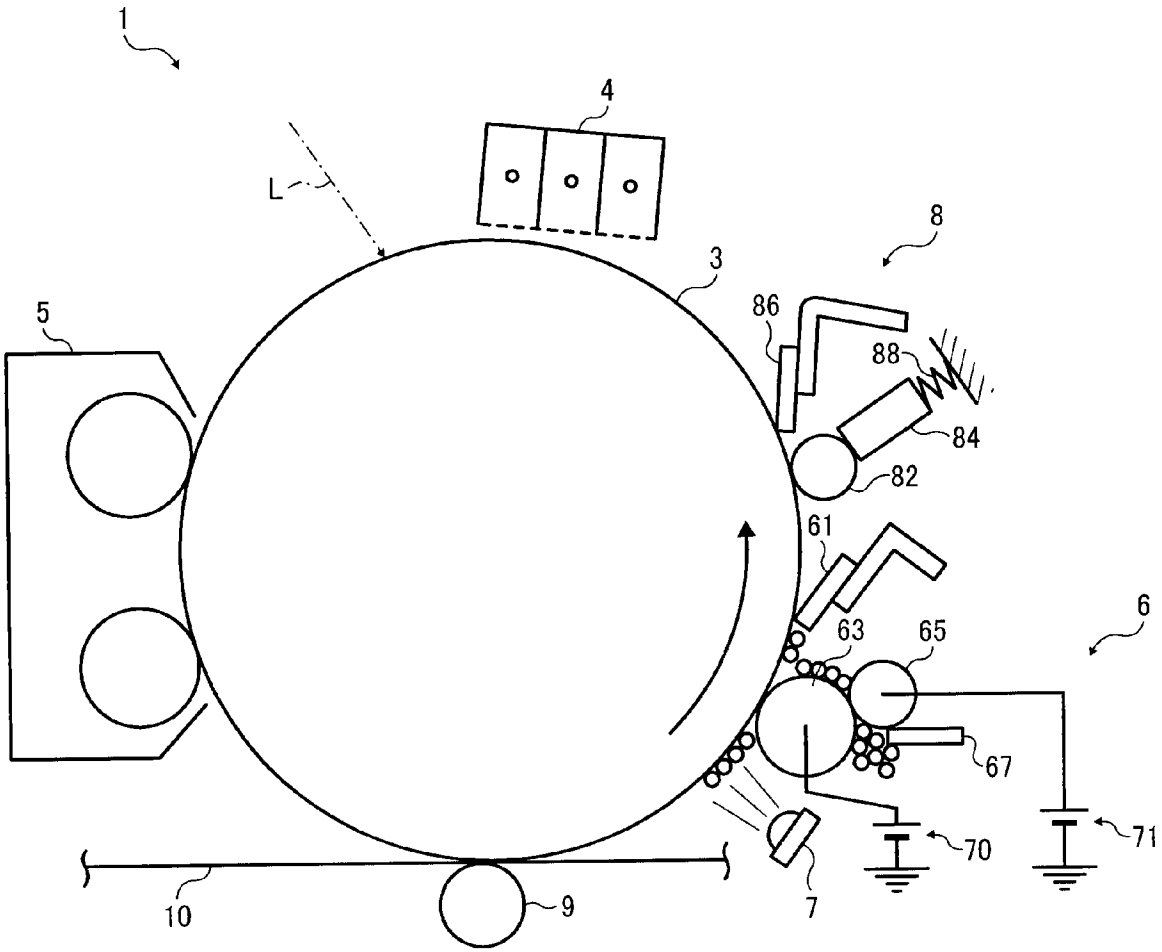
FIG. 6 is a schematic view of an image-forming device of the image forming apparatus according to one embodiment.

FIG. 6 shows a schematic view of the image forming device 1 of a present implementation.

As shown in FIG. 6, the image-forming device 1 includes a process cartridge that accommodates at least the photoconductive drum 3, a charge device 4, a developing device 5, a cleaning device 6, a charge-removing lamp 7, and a lubricant applying device 8. The process cartridge is exchangeable and detachable as a unit from the image forming apparatus. However, each of the photoconductive drum 3, the charge device 4, the developing device 5, the cleaning device 6, the charge-removing lamp 7, and the lubricant applying device 8 may be exchangeable.

A cleaning device 6 includes the electrostatic cleaning brush roller 63 and the cleaning blade 61 in order from an upstream side with respect to the rotation of the photoconductive drum 3.

The electrostatic cleaning brush roller 63 rotates in a same direction of rotation as the photoconductive drum 3, as indicated by an arrow in FIG. 6. The electrostatic cleaning brush roller 63 may be a driven roller to rotate against the photoconductive drum 3.

The cleaning blade 61 is mounted by a holder, and contacts the photoconductive drum 3 in a counter direction with respect to a rotation direction of the photoconductive drum 3.

A cleaning power supply 70 as a bias voltage applying member applies a bias voltage to the electrostatic cleaning brush roller 63 to remove toner electrically. After transferring a toner image from a photoconductive drum 3 to the intermediate transfer belt 10, untransferred positive toner and untransferred negative toner on a surface of the photoconductive drum reach a contact portion of the photoconductive drum and the electrostatic cleaning brush roller 63. The electrostatic cleaning brush roller 63 removes the untransferred toner by electrostatic force and frictional force.

After the charge-removing lamp 7 removes a charge on the surface of the photoconductive drum 3, the electrostatic cleaning brush roller 63 removes almost all untransferred toner on the surface of the photoconductive drum 3. After that, the cleaning blade 61 removes untransferred residual toner on the surface of the photoconductive drum.

A collection roller 65, to which is applied bias voltage by a collection power supply 71, removes the toner on the electrostatic cleaning brush roller 63 electrically. The collection blade 67, which contacts a surface of the collection roller 65, removes the toner on the surface of the collection roller 65.

The applying blush 82 of a lubricant applying device applies a lubricant on the surface of the photoconductive drum 3 for protecting the surface of the photoconductive drum 3, after toner is removed by the electrostatic cleaning brush roller 63.

A lubricating blade 86 contacts the surface of the photoconductive drum 3 in a counter direction with respect to the rotating direction of the photoconductive drum 3, and smoothes the lubricant on the surface of the photoconductive drum 3.

Figure 7:
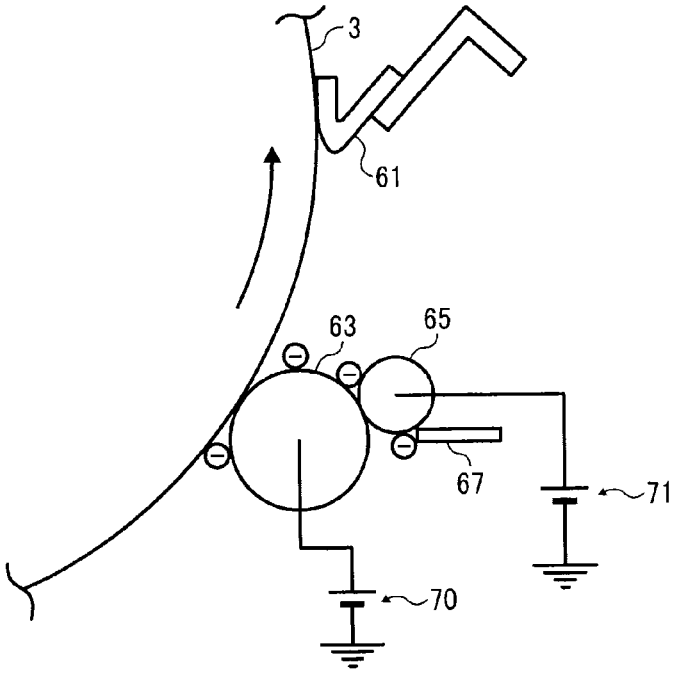
FIG. 7 illustrates a state in which an entrainment of the cleaning blade occurs.

The lubricant body 84, which is mounted on a bracket, is pressed against the applying blush 82 by a pressuring spring 88. The applying blush 82 wipes the lubricant body 84 and applies the lubricant to the photoconductive drum 3. Zinc stearate as a lubricant is applied to the whole circumference of the photoconductive drum 3 according to rotation of the photoconductive drum 3. Thus, by passing granules of Zinc stearat to the cleaning blade 61, the cleaning blade 61 prevents the photoconductive drum 3 from fitting strongly and prevents an entrainment, as shown in FIG. 7.

When the printer prints a large number of sheets, including an image with a high image-area ratio according to the construction in FIG. 6, the developing device 5 develops a toner image on the surface of the photoconductive drum 3 using a large amount of toner.

Thus, there remains a large amount of untransferred toner on the photoconductive drum after transferring the toner to the intermediate transfer belt 10.

First, the electrostatic cleaning brush roller 63 removes a large amount of untransferred negative toner on the surface of the photoconductive drum 3.

The electrostatic cleaning brush roller 63 prevents silica from sticking to the surface of the photoconductive drum 3 when the silica passes between the photoconductive drum 3 and the electrostatic cleaning brush roller 63 because the electrostatic cleaning brush roller 63 does not contact the photoconductive drum 3 strongly, and does not stress the untransferred toner mechanically.

A little untransferred positive toner, which is not removed by the electrostatic cleaning brush roller 63, reaches a contact portion of the photoconductive drum 3 and the cleaning blade 61 according to a rotation of the photoconductive drum 3.

An edge of the cleaning blade 61 is able to remove the residual toner easily.

Moreover, the edge of the cleaning blade 61 is prevented from an abrasion because little residual toner reaches the contact portion of the photoconductive drum 3 and the cleaning blade 61. Moreover, the photoconductive drum 3 is prevented from being scraped by toner and adhering silica because the residual toner does not receive stress.

Alternatively, when the printer prints a sheet including an image with a low image-area ratio that is almost all blank, the developing device 5 develops a toner image on the surface of the photoconductive drum 3 using a small amount of toner. Thus, there remains a small amount of untransferred toner on the photoconductive drum 3 after transferring the toner on the intermediate transfer belt 10. Little untransferred toner reaches a contact portion of the photoconductive drum 3 and the cleaning blade 61 according to a rotation of the photoconductive drum 3 because the electrostatic cleaning brush roller 63 removes almost all of the untransferred toner.

Note that it is unnecessary to increase consumption of the lubricant by arranging the lubricant applying device 8 downstream of the cleaning blade 61 with respect to rotation of the photoconductive drum 3. Thus, the lubricant applying device 8 improves the lifetime of the image forming device by decreasing consumption of the lubricant.

As mentioned above, each of the electrostatic cleaning brush roller 63, the cleaning blade 61, and the lubricant applying device 8 in FIG. 6 improves the lifetime of the image forming device according to the arrangement and construction of those devices.

Figure 8:
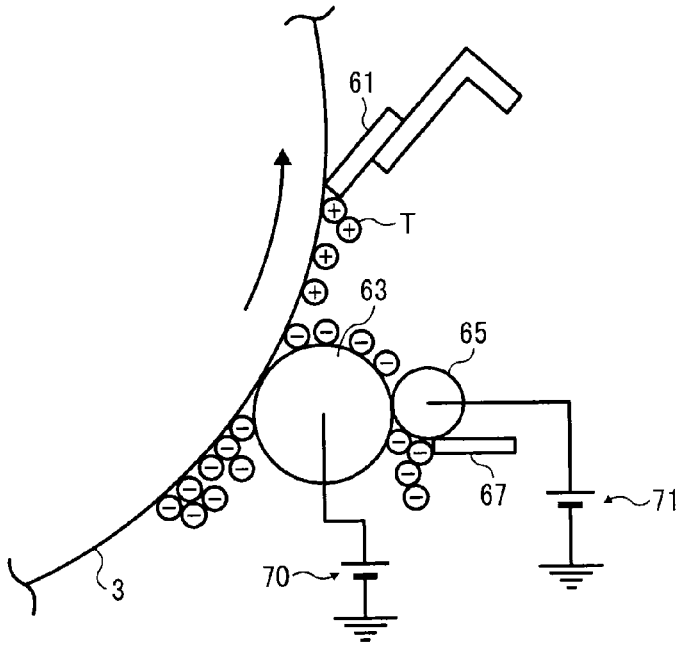
FIG. 8 is enlarged view of the cleaning device shown in FIG. 6.

FIG. 8 is enlarged view of the cleaning device 6 shown in FIG. 6.

Figure 9:
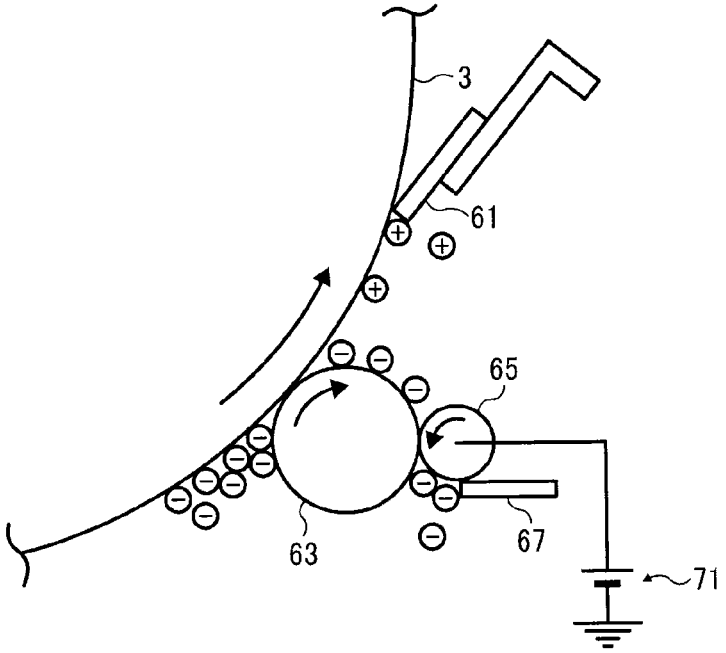
FIG. 9 illustrates a collection roller applying a voltage by a power supply device.

FIG. 8 shows that the cleaning power supply 70 applies a bias voltage to the electrostatic cleaning brush roller 63, and the collection power supply 71 applies a bias voltage to the collection roller 65. However, the collection power supply may apply a bias voltage to the collection roller 65, as shown in FIG. 9. Moreover, the collection power supply may apply a bias voltage to the collection blade 67.

Figure 10:
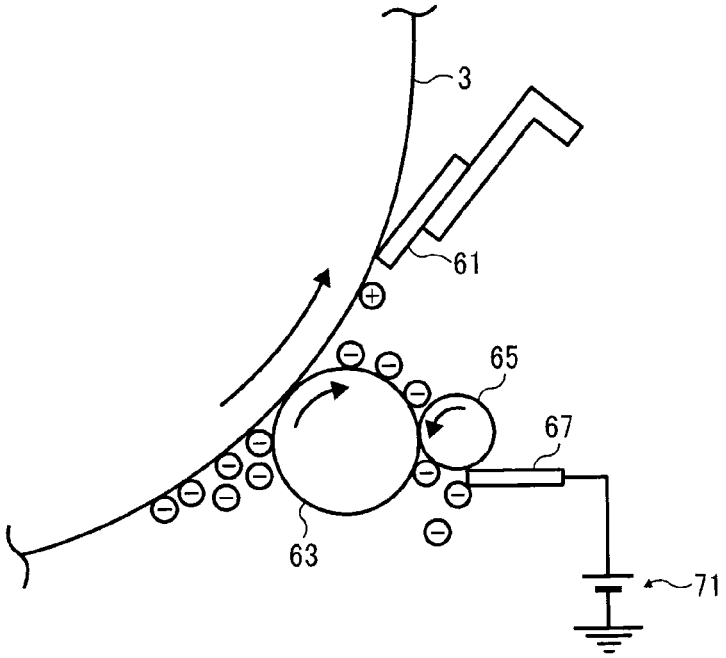
FIG. 10 illustrates a collection blade applying a voltage by a power supply device.
Figure 11:
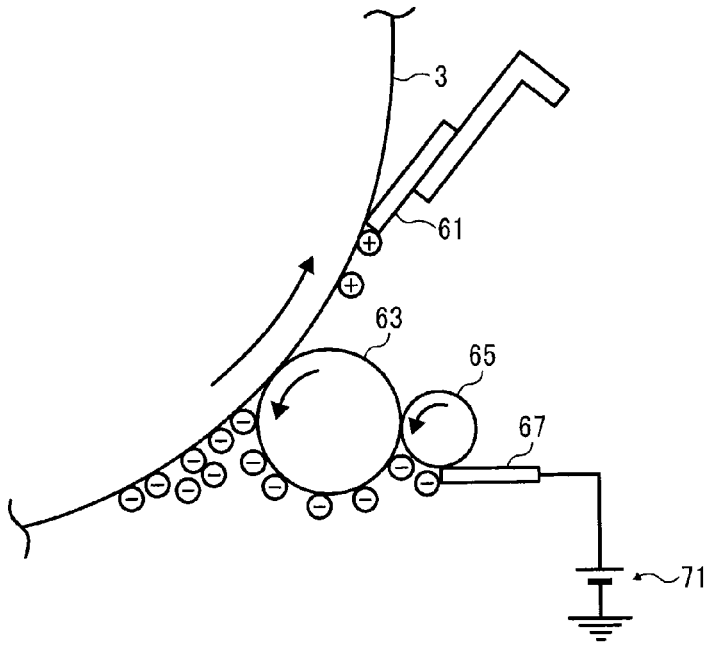
FIG. 11 illustrates an electrostatic cleaning roller rotating in a same direction as the photoconductive drum.

A rotation direction of the electrostatic cleaning brush roller 63 is not limited in FIGS. 9 and 10. The electrostatic cleaning brush roller 63 may rotate in the direction shown in FIG. 11.

Next, another embodiment of an image forming apparatus is illustrated as follows.

FIG. 1 is a schematic view of a location of each of the photoconductive drums 3Y, 3M, 3C, and 3K and an intermediate transfer belt 10 according to a full-color mode.

When the full-color mode is active, each of the photoconductive drums 3Y, 3M, 3C, and 3K contacts the intermediate transfer belt 10 and forms a transfer nip with each of the primary transfer rollers 9Y, 9M, 9C, and 9K. The image forming apparatus prints a sheet with a full-color image using all image forming devices 1Y, 1M, 1C, and 1K.

The exposure device 21 starts to write respective latent electrostatic images on each of the photoconductive drums 3Y, 3M, 3C, and 3K after rotating all photoconductive drums 3Y, 3M, 3C, and 3K.

Each of the photoconductive drums 3Y, 3M, 3C, and 3K stops rotating after removing untransferred toner on all photoconductive drums 3Y, 3M, 3C, and 3K using at least the electrostatic cleaning brush roller 63.

Figure 12:
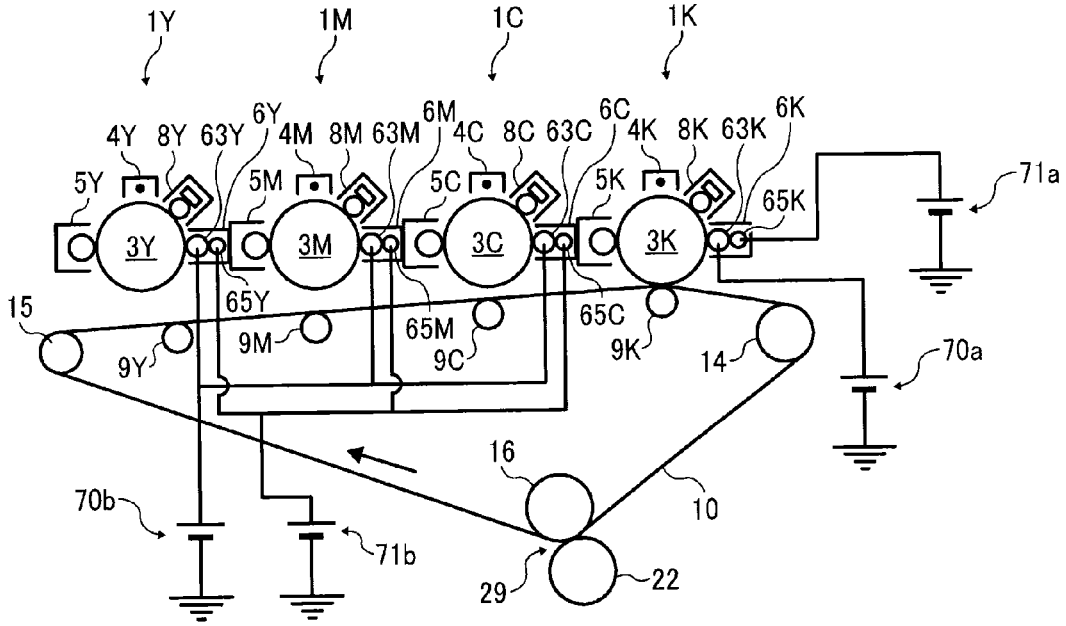
FIG. 12 is a schematic view of each photoconductive drum and an intermediate transfer belt according to a monochrome mode.

FIG. 12 is a schematic view of a location of each of the photoconductive drums 3Y, 3M, 3C, and 3K and an intermediate transfer belt 10 according to a monochrome mode.

When the monochrome mode is active, it is not necessary to operate the image forming devices 1Y, 1M, and 1C because the image forming apparatus prints a sheet with a monochrome image using only the image forming device 1K. Thus, a contact/separate mechanism 19 (shown in FIG. 15) controls the movement of the intermediate transfer belt 10 in FIG. 12.

Thus, this construction prevents supplies (such as toner) of the image forming devices 1Y, 1M, and 1C from being overconsumed.

According to the image forming apparatus of one embodiment, the cleaning power supply 70*a* for black applies a bias voltage directly/indirectly to the electrostatic cleaning brush roller 63K of the cleaning device 6K.

Alternatively, a single cleaning power supply 70*b* for color applies a bias voltage directly/indirectly to the electrostatic cleaning brush rollers 63Y, 63M, and 63C of the cleaning devices 6Y, 6M, and 6C.

Thus, this construction is able to reduce the number of cleaning power supplies for color compared to that of a cleaning power supply corresponding with each of the electrostatic cleaning brush rollers 63Y, 63M, and 63C, to improve the cost and size of the image forming device.

By separating the cleaning power supply for color and monochrome, power consumption is reduced because the cleaning power supply 70*b* for color does not apply a bias voltage in the monochrome mode.

When the image forming apparatus includes the cleaning power supply 70 and the collection power supply 71, as shown in FIGS. 1 and 8, the collection power supply may be constituted as follows. For example, the collection power supply 71*a* applies a bias voltage to the collection roller 65K. Single collection power supply 71*b* may apply a bias voltage to the collection rollers 65Y, 65M, and 65C. Herewith, the number of the collection power supply for color is reduced compared to that of a collection power supply corresponding with each of the collection rollers 65Y, 65M, and 65C, to improve the cost and size of the image forming device.

When the collection power supply 71 applies a bias voltage to the collection roller 65, as shown in FIG. 9, the collection power supply 71*a* for black may apply a bias voltage to the collection roller 65K, and a single collection power supply 71*b* may apply a bias voltage to the collection rollers 63Y, 63M, and 63C.

Moreover, as shown in FIG. 10, when the collection power supply 71 applies the collection blade 67, the collection power supply may be constituted as follows. The collection power supply 71*a* for black may apply a bias voltage to the collection blade 67K, and the collection power supply 71*b* for color may apply a bias voltage to the collection blades 67Y, 67M, and 67C.

Configuration Example 1

Figure 13:
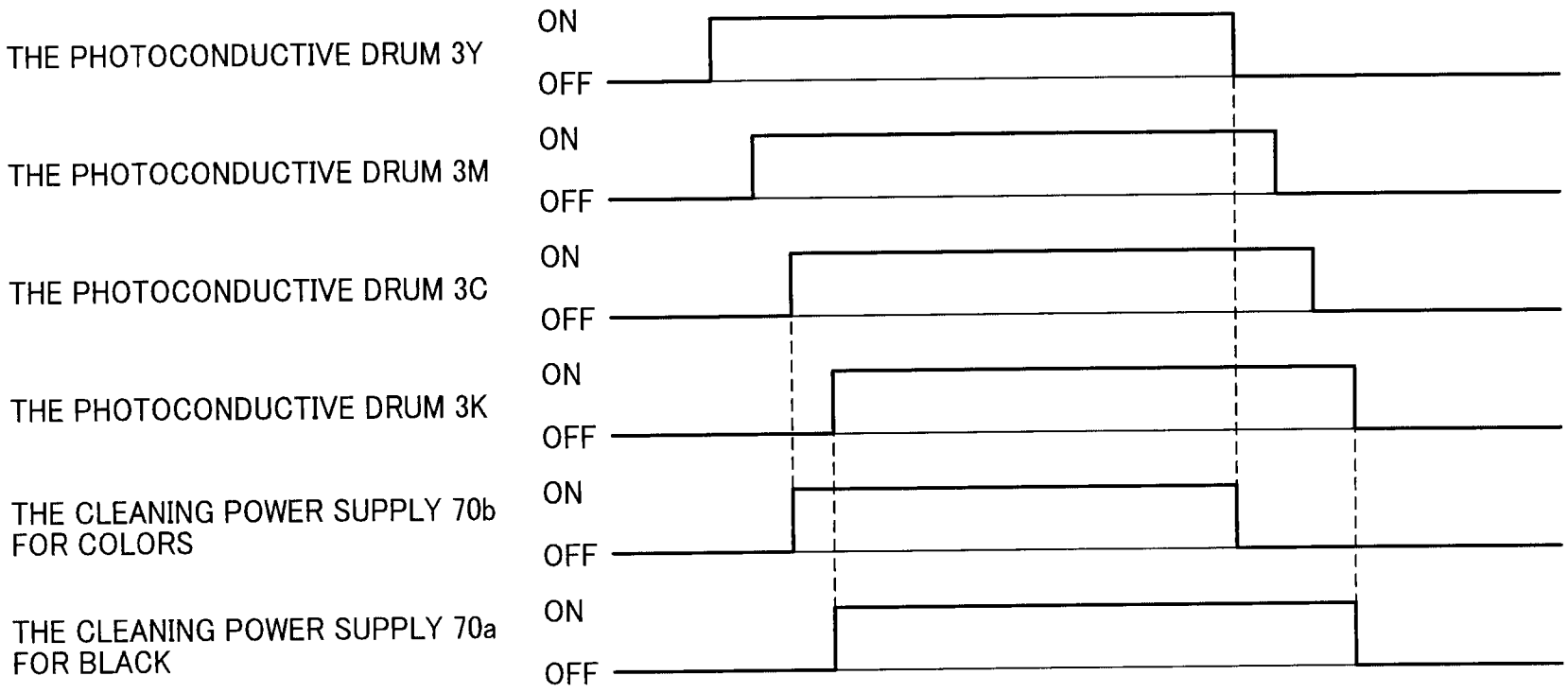
FIG. 13 is a timing diagram regarding rotation control of each photoconductive drum and a voltage applying control of the power supply device for black and color.

FIG. 13 is a timing diagram regarding a rotation control of each photoconductive drum and a voltage applying control of the power supply device for black and color according to configuration example 1.

When the image forming apparatus starts to print a sheet in full-color mode, a timing when the cleaning power supply 70*b* for color starts to apply a bias voltage is the same timing as the photoconductive drum, which is the last starting time to start rotating among the photoconductive drums 3Y, 3M, and 3C.

The cleaning power supply 70*b* for color starts to apply a bias voltage at a same timing when the photoconductive drum 3C starts rotating, because the photoconductive drum in FIG. 1 starts rotating in order of the photoconductive drums 3Y, 3M, and 3C.

When finishing an operation of image formation in full-color mode, timing when the cleaning power supply 70*b* for color stops applying a bias voltage is the same timing as the photoconductive drum, which is the first stopping time to stop rotating among the photoconductive drums 3Y, 3M, and 3C. The cleaning power supply 70*b* for color stops applying a bias voltage at a same timing when the photoconductive drum 3Y stops rotating, because the photoconductive drum in FIG. 1 stops rotating in order of the photoconductive drums 3Y, 3M, and 3C.

Thus, with this timing, the stationary photoconductive drums 3Y, 3M, and 3C are prevented from having the electrostatic cleaning brush rollers 63Y, 63M, and 63C being applied a bias voltage by the cleaning power supply 70*b*, while the rollers from continue to contact the stationary photoconductive drums. As a result, this prevents the photoconductive drums 3Y, 3M, and 3C from density irregularities of image according to a non-uniform charge. Moreover, this prevents the photoconductive drums 3Y, 3M, and 3C from errors resulting from electrostatic bastardization based on long-term operation.

Moreover, when finishing an operation of image formation in full-color mode, timing when the cleaning power supply 70*a* for black starts to apply a bias voltage is the same timing as when the photoconductive drum 3K starts rotating, regardless of timing when the photoconductive drums 3Y, 3M, and 3C start rotating. Timing when the cleaning power supply 70*a* for black stops applying the bias voltage is the same timing as when the photoconductive drum 3K stops rotating, regardless of timing when the photoconductive drums 3Y, 3M, and 3C start rotating.

Based on a driving starting signal and a driving stopping signal transmitted to the driving motor 92, the cleaning power supply 70*a* for black and the cleaning power supply 70*b* for colors control timing of starting and stopping applying a bias voltage.

In case of the collection power supply 71 in FIGS. 9 and 10, the cleaning power supply 70*a* in FIG. 13 is replaced by the collection power supply 71 for black, and the cleaning power supply 70*b* in FIG. 13 is replaced by the collection power supply 71 for color.

Moreover, when both the cleaning power supply 70 and the collection power supply 71 apply a bias voltage in FIG. 8, timing when the cleaning power supplies 70*a* and 70*b* in FIG. 13 apply a bias voltage to the electrostatic cleaning brush rollers 63K, 63Y, 63M, and 63C may be the same timing as when the collection power supply 71 applies a bias voltage to the collection roller 65. Otherwise, timing when the collection power supply 71 starts to apply a bias voltage to the collection roller 65 or the collection blade 67 is a predetermined time after the cleaning power supplies 70*a* and 70*b* start to apply to a bias voltage in FIG. 13. The predetermined time is the time it takes for toner to travel from the electrostatic cleaning brush roller 63 to the collection roller 65.

Configuration Example 2

Figure 14:
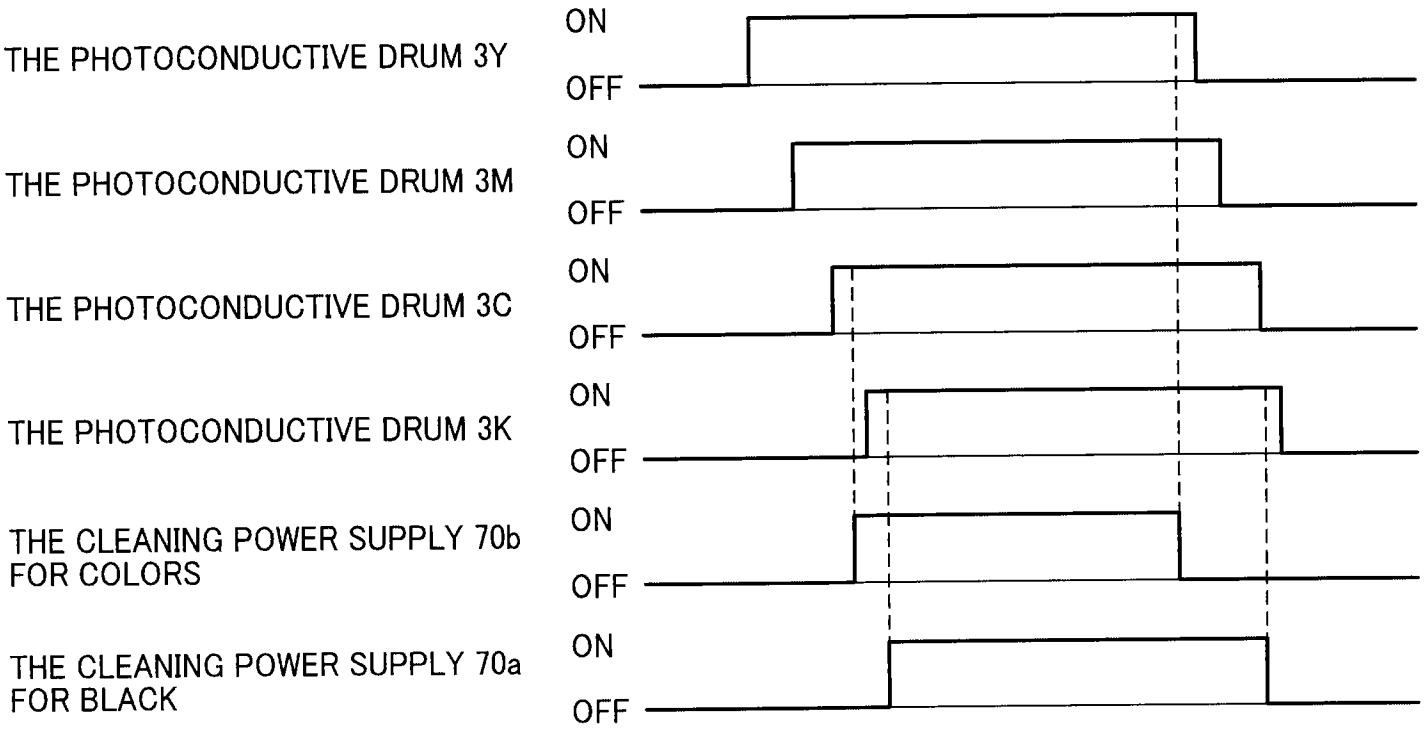
FIG. 14 is a timing diagram regarding rotation control of each photoconductive drum and a voltage applying control of the cleaning power supply device for black and color.

FIG. 14 is a timing diagram regarding a rotation control of each photoconductive drum 3Y, 3M, 3C, and 3K and a voltage applying control of the cleaning power supply 70*a* for black and the cleaning power supply 70*b* for color.

When the image forming apparatus starts to print a sheet in full-color mode, a timing when the cleaning power supply 70*b* for color starts to apply a bias voltage is a predetermined time after the photoconductive drum that is the last starting time to start rotating among the photoconductive drums 3Y, 3M, and 3C. The cleaning power supply 70*b* for color starts to apply a bias voltage a predetermined time after the photoconductive drum 3C starts to rotate, because the photoconductive drum in FIG. 1 starts to rotate in order of the photoconductive drums 3Y, 3M, and 3C.

When finishing an operation of image formation in full-color mode, a timing when the cleaning power supply 70*b* for color stops applying a bias voltage is a predetermined time before the photoconductive drum that is the first stopping time to rotate of the photoconductive drums 3Y, 3M, and 3C. The cleaning power supply 70*b* for color stops applying a bias voltage a predetermined time before the photoconductive drum 3Y stops rotating, because the photoconductive drum in FIG. 1 stops rotating in order of the photoconductive drums 3Y, 3M, and 3C.

Thus, with this timing, the stationary photoconductive drums 3Y, 3M, and 3C are prevented from having the electrostatic cleaning brush rollers 63Y, 63M, and 63C being applied a bias voltage by the cleaning power supply 70*b*, while the rollers continue to contact the stationary photoconductive drums, as in configuration example 1. As a result, this prevents the photoconductive drums 3Y, 3M, and 3C from density irregularities in an image according to a non-uniform charge. Moreover, this prevents the photoconductive drums 3Y, 3M, and 3C from errors resulting from electrostatic bastardization based on long-term operation, as in configuration example 1.

Moreover, when finishing an operation of image formation in the full-color mode, a timing when the cleaning power supply 70*a* for black starts to apply a bias voltage is a predetermined time after the photoconductive drum 3K starts to rotate, regardless of timing when the photoconductive drums 3Y, 3M, and 3C start to rotate. A timing when the cleaning power supply 70*a* for black stops applying the bias voltage is a predetermined time before the photoconductive drum 3K stops rotating, regardless of timing when the photoconductive drums 3Y, 3M, and 3C start to rotate.

Based on a driving starting signal and a driving stopping signal transmitted to the driving motor 92, the cleaning power supply 70*a* for black and the cleaning power supply 70*b* for color control timing of starting and stopping to apply a bias voltage.

In case of the collection power supply 71 in FIGS. 9 and 10, the cleaning power supply 70*a* in FIG. 14 is replaced by the collection power supply 71 for black, and the cleaning power supply 70*b* in FIG. 14 is replaced by the collection power supply 71 for color.

The collection power supply 71 may continue to apply a bias voltage to the collection roller 65 after a predetermined time (for example, several minutes) when the cleaning power supply 70 stops applying a bias voltage to the electrostatic cleaning brush roller 63, in the embodiment of FIG. 8. Thus, a cleaning performance of the photoconductive drum 3 by the electrostatic cleaning brush roller 63 is maintained because toner on the electrostatic cleaning brush roller 63 is removed by the collection roller 65.

Moreover, timing when the cleaning power supply 70*a* and 70*b* in FIG. 14 apply a bias voltage to the electrostatic cleaning brush rollers 63K, 63Y, 63M, and 63C may be the same timing as when the collection power supply 71 applies a bias voltage to the collection roller 65.

Otherwise, timing when the collection power supply 71 starts to apply a bias voltage to the collection roller 65 or the collection blade 67 may be a predetermined time after the cleaning power supplies 70*a* and 70*b* start to apply a bias voltage. The predetermined time is the time that it takes toner to travel from the electrostatic cleaning brush roller 63 to the collection roller 65.

The number of the image forming devices 1Y, 1M, 1C, and 1K are not limited to that shown in FIGS. 1 and 12. Also, the order of the image forming devices 1Y, 1M, 1C, and 1K are not limited in that shown in FIGS. 1 and 12.

Moreover, an object to which the power supply device as the cleaning power supply 70 applies a bias voltage is not limited to the electrostatic cleaning brush roller 63.

For example, a power supply 91 (shown in FIG. 15) for black may apply a bias voltage to the charge device 4K, and a power supply 91 (shown in FIG. 15) for color may apply a bias voltage to the charge devices 4Y, 4M, and 4C. By separating the power supply for color and monochrome, power consumption is reduced because the power supply for color does not apply a bias voltage in monochrome mode.

A single power supply for color applies a bias voltage to a component, such as the charge devices 4Y, 4M, and 4C.

Thus, the number of the power supplies for color is reduced compared to that of a power supply corresponding with each charge devices 4Y, 4M, and 4C, and the cost and size of the image forming apparatus is improved.

The invention claimed is:

1. An image forming apparatus, comprising:

a first image forming device to form a first toner image, the first image forming device including a first photoconductive member and a first brush;

a plurality of second image forming devices to form corresponding toner images;

a first bias voltage supply device to apply a first bias voltage to a first component of the first image forming device; and a second bias voltage supply device to apply a second bias voltage to a second component of each of the plurality of second image forming devices, wherein each second image forming device includes a second photoconductive member that is rotatable and forms the corresponding toner image and a second brush to remove toner on a surface of each second photoconductive member;

each second component is the second brush;

each second image forming device includes a cleaning blade to remove remaining toner after the second brush removes the toner on the surface of the second photoconductive member; and wherein the second bias voltage supply device stops applying the second bias voltage to each second component at an earliest time among times at which each of the second photoconductive members stops rotating, when finishing each operation of image formation.

2. The image forming apparatus according to claim 1, wherein the second bias voltage supply device starts applying the second bias voltage to each second component at a time when a last one of the second photoconductive members starts rotating.

3. The image forming apparatus according to claim 2, wherein the first photoconductive member is rotatable and forms the first toner image;

the first bias voltage supply device starts and stops applying the first bias voltage to the first component at a same time that the first photoconductive member starts and stops rotating, respectively.

4. The image forming apparatus according to claim 1, wherein each second image forming device includes a second collection member to remove toner on the second brush electrically;

the image forming apparatus further includes a third collection power supply device to apply a voltage to each second collection member for adhering the toner electrically; and the third collection power supply continues applying the voltage to each second collection member until a predetermined time after the second bias voltage supply device stops applying the second bias voltage to the second brush.

5. The image forming apparatus according to claim 1, wherein the first image forming device includes a first charge device to charge a surface of a first photoconductive member;

each second image forming device includes a second charge device to charge a surface of each second photoconductive member;

the image forming apparatus further includes an exposure device to irradiate and write a latent image on a surface of the first and second photoconductive members; and the first and second photoconductive members stop rotating when the first and second brushes remove toner on the first and second photoconductive members after the exposure device writes a latent image on a surface of the first and second photoconductive members.

6. An image forming apparatus, comprising:

a first image forming device to form a first toner image;

a plurality of second image forming devices to form corresponding toner images;

a first bias voltage supply device to apply a first bias voltage to a first component of the first image forming device; and a second bias voltage supply device to apply a second bias voltage to a second component of each of the plurality of second image forming devices, wherein each second image forming device includes a photoconductive member that is rotatable and forms the toner image; and the second bias voltage supply device stops applying the second bias voltage to each second component before each of the photoconductive members stops rotating, when finishing each operation of image formation.

7. An image forming apparatus, comprising:

a first image forming device, including a first photoconductive member, to form a first toner image;

a plurality of second image forming devices to form corresponding toner images;

a first bias voltage supply device to apply a first bias voltage to a first component of the first image forming device; and a second bias voltage supply device to apply a second bias voltage to a second component of each of the plurality of second image forming devices, wherein each second image forming device includes a second photoconductive member that is rotatable and forms the toner image;

each of the second photoconductive members starts rotating at a different time; and the second bias voltage supply device starts applying the second bias voltage to each second component after each of the second photoconductive members starts rotating, when starting an operation of image formation.

8. The image forming apparatus according to claim 7, wherein the first image forming device includes a first photoconductive member that is rotatable and forms the first toner image; and the first bias voltage supply device starts applying the first bias voltage to the first component after the first photoconductive member starts rotating.

9. The image forming apparatus according to claim 7, wherein the first image forming device includes a first photoconductive member that is rotatable and forms the first toner image; and the first bias voltage supply device stops applying the first bias voltage to the first component before the first photoconductive member stops rotating.

10. The image forming apparatus according to claim 7, wherein the second bias voltage supply device stops applying the second bias voltage to each second component before each of the second photoconductive members stops rotating.

11. The image forming apparatus according to claim 7, wherein each second image forming device includes a second brush to remove toner on a surface of each second photoconductive member; and each second component is the second brush.

12. The image forming apparatus according to claim 11, wherein each second image forming device includes a second collection member to remove toner on each second brush electrically;

the image forming apparatus further includes a third collection power supply device to apply a voltage to each second collection member for adhering the toner electrically; and the third collection power supply continues applying the voltage to each second collection member until a predetermined time after the second bias voltage supply device stops applying the second bias voltage to each second brush.

13. The image forming apparatus according to claim 11, wherein the first image forming device includes a first charge device to charge a surface of the first photoconductive member;

each second image forming device includes a second charge device to charge a surface of each second photoconductive member;

the image forming apparatus further includes an exposure device to irradiate and write a latent image on a surface of the first and second photoconductive members; and the first and second photoconductive members stop rotating when the first and second brushes remove toner on the first and second photoconductive members after the exposure device writes a latent image on a surface of the first and second photoconductive members.

14. The image forming apparatus according to claim 1, wherein the first image forming device forms a monochrome image when a monochrome mode is active, and the first image forming device and the second image forming devices form a color image when a color mode is active.

15. The image forming apparatus of claim 6, wherein the second bias voltage supply device starts applying the second bias voltage to each second component after each of the photoconductive members starts rotating.

16. The image forming apparatus of claim 6, wherein each second image forming device includes a second brush to remove toner on a surface of each photoconductive member; and each second component is the second brush.

17. The image forming apparatus of claim 1, wherein the first brush removes toner on a surface of the first photoconductive member and the first image forming device further comprises:

a first cleaning blade to remove remaining toner after the first brush removes the toner on the surface of the first photoconductive member; and a lubricant applying device to apply a lubricant to the surface of the first photoconductive member, wherein the first cleaning blade is located between the first brush and the lubricant applying device in a rotation direction of the first photoconductive member.

18. The image forming apparatus of claim 1, wherein the first brush removes toner on a surface of the first photoconductive member and the first image forming device further comprises:

a first cleaning blade to remove remaining toner after the first brush removes the toner on the surface of the first photoconductive member; and a charge-removing device to remove a charge on the surface of the first photoconductive member, wherein the first brush is located between the charge-removing device and the first cleaning blade in a rotation direction of the first photoconductive member.

19. The image forming apparatus of claim 6, wherein the second bias voltage supply device applies a zero voltage to each second component when stopping application of the second bias voltage, before each of the photoconductive members stops rotating, when finishing each operation of image formation.

* * * * *